US005611227A

United States Patent [19]

Solovieff

[11] Patent Number: 5,611,227

[45] Date of Patent: Mar. 18, 1997

[54] HANDLESET WITH THUMB PIECE AND RACK

[75] Inventor: Paul G. Solovieff, Tustin, Calif.

[73] Assignee: Emhart Inc., Newark, Del.

[21] Appl. No.: 673,776

[22] Filed: Jun. 27, 1996

[51] Int. Cl.[6] ..... E05B 55/06

[52] U.S. Cl. ..... 70/472; 70/149; 70/218; 70/DIG. 73; 292/169.14; 292/DIG. 27

[58] Field of Search ..... 70/472, 218, 149, 70/190, 224, 207, 208, 483–485, 489, 422, DIG. 31, DIG. 73; 292/169.14, 169.17, 172, 142, DIG. 27

[56] References Cited

U.S. PATENT DOCUMENTS

| | | | |
|---|---|---|---|
| 2,442,763 | 6/1948 | Falk | 70/211 |
| 2,854,270 | 9/1958 | Ward | 292/169.14 |
| 4,052,092 | 10/1977 | Bergen | 292/172 |
| 4,276,760 | 7/1981 | Nolin | 70/110 X |
| 4,333,324 | 6/1982 | Dietrich et al. | 292/172 |
| 4,418,552 | 12/1983 | Nolin | 70/110 X |
| 4,615,549 | 10/1986 | Couture | 292/337 X |
| 4,623,174 | 11/1986 | Trull et al. | 292/1.5 |
| 4,711,477 | 12/1987 | Fann et al. | 292/169.14 |
| 4,718,706 | 1/1988 | Fang | 292/337 |
| 4,725,085 | 2/1988 | Hu et al. | 292/172 |
| 4,750,766 | 6/1988 | Shen | 292/169.14 X |
| 4,927,195 | 5/1990 | Wu et al. | 292/169.14 |
| 4,934,800 | 6/1990 | Choi | 292/172 |
| 4,982,986 | 1/1991 | Gressett et al. | 292/165 X |
| 5,060,991 | 10/1991 | Davidian et al. | 292/172 |
| 5,088,778 | 2/1992 | Lin | 292/336.3 |
| 5,123,683 | 6/1992 | Solovieff | 292/172 |
| 5,169,184 | 12/1992 | Bishop | 292/1.5 |
| 5,257,837 | 11/1993 | Bishop | 292/1.5 |
| 5,354,109 | 10/1994 | Lin | 292/169.14 X |
| 5,513,510 | 5/1996 | Solovieff et al. | 70/472 |

*Primary Examiner*—Lloyd A. Gall
*Attorney, Agent, or Firm*—Spencer T. Smith

[57] ABSTRACT

A handleset having a half round spindle for operating a latch assembly when rotated from a neutral orientation, a cylinder lock having a key operated cylinder assembly which rotates a round spindle, a driving pinion mounted for rotation on the round spindle, a rack having teeth engaged with the pinion, a connector displaceable between down and up positions, a pivotal thumb piece having a lever for displacing the connector from the down position to the up position, the connector having an arcuate slot, a locking arm having an arcuate flange for location in the arcuate slot, an axially extending pin, and a central opening, the round spindle including a cam secured thereto at a location selected so that the cam will be located within the opening, the cam and the opening being selectively configured so that turning the key from the neutral orientation to the lock open position will result in the cam rotating the locking arm from a first position whereat the arcuate flange is at one end of the arcuate slot to a second position whereat the arcuate flange is at the other end of the arcuate slot, and the rack having a slot for receiving the pin, the rack slot being configured to prevent relative vertical movement between the rack and the locking arm when the locking arm is at the first position and to permit relative vertical movement between the rack and the locking arm when the locking arm is at the second position.

4 Claims, 4 Drawing Sheets

HANDLESET WITH THUMB PIECE AND RACK

The present application relates to handlesets which are characterized by a key operated cylinder which enables the movement of a thumb piece to open the door.

A prior art handleset is disclosed in U.S. Pat. No. 5,513,510.

It is an object of the present invention to provide an improved handleset.

Other objects and advantages of the present invention will become apparent from the following portion of this specification and from the accompanying drawings which illustrate in accordance with the mandate of the patent statutes a presently preferred embodiment incorporating the principles of the invention.

Referring to the drawings.

Figure 1:
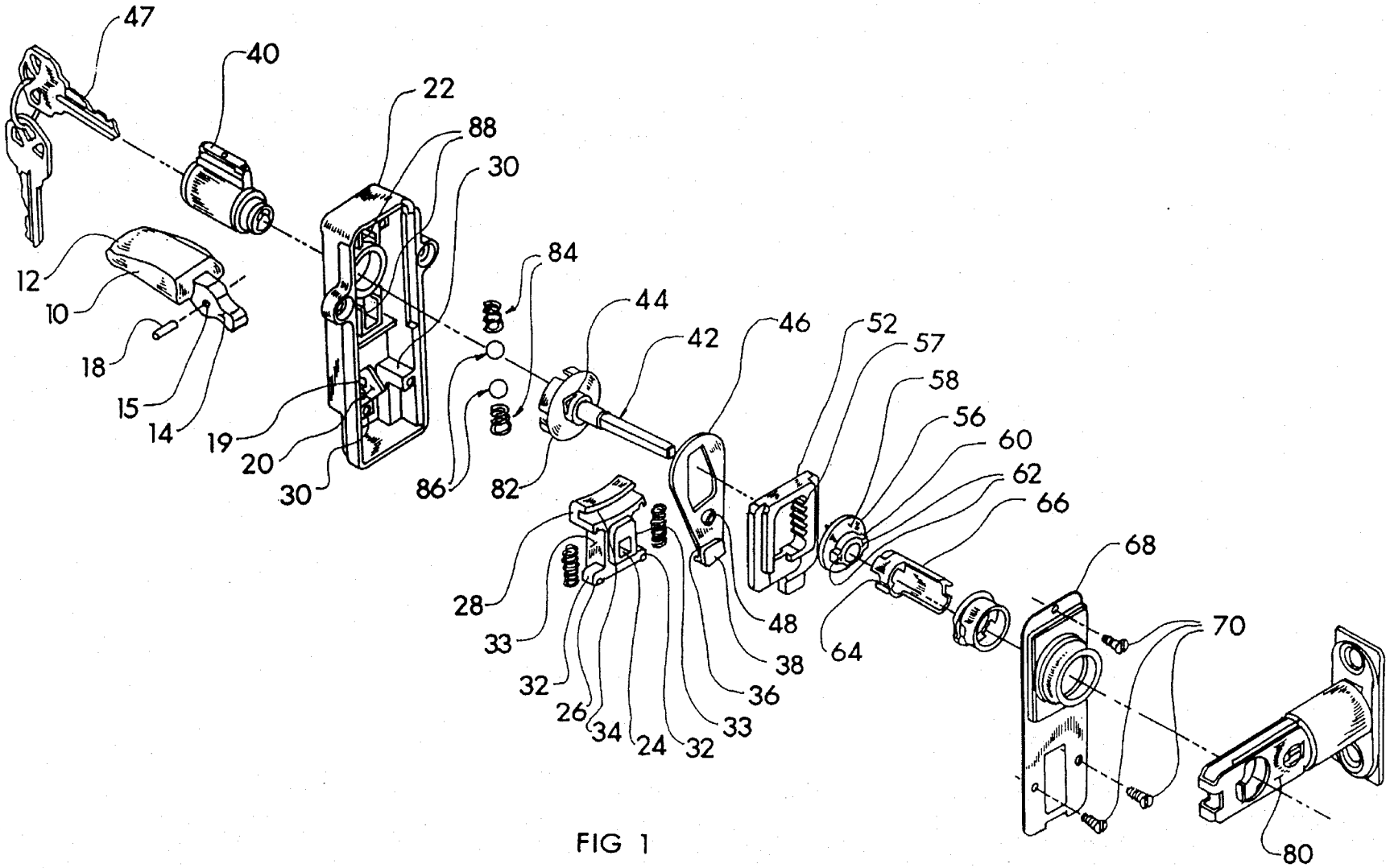
FIG. 1 is an oblique separated view of the handleset made in accordance with the teachings of the present invention.

The handleset includes a thumb piece 10 which has a flat thumb engageable pad 12 and an operating lever portion 14 which has a cross hole 15 for receiving a pivot pin 18 supported between opposed notches 19 defined between support brackets 20 (only one shown) and the inner surface of casing 22. The end of the lever portion 14 passes through an opening (not shown) in the casing 22 which is located between the support brackets 20 and is received by an opening 24 in a connector 26 which has an upper outwardly projecting flange 28 which will rest on the top surface of a pair of ribs 30. Compressively located between the bottom of the ribs and the outwardly projecting lower arms 32 of the connector 26 are a pair of compression springs 33 to establish a neutral connector position with flange 28 resting on the ribs 30. The connector flange 28 has a arcuate slot 34 which receives the bottom arcuate bent end 36 of a locking arm 38. Depressing the thumb piece pad 12 accordingly lifts the connector 26 and the interconnected locking arm 38.

Figure 2:
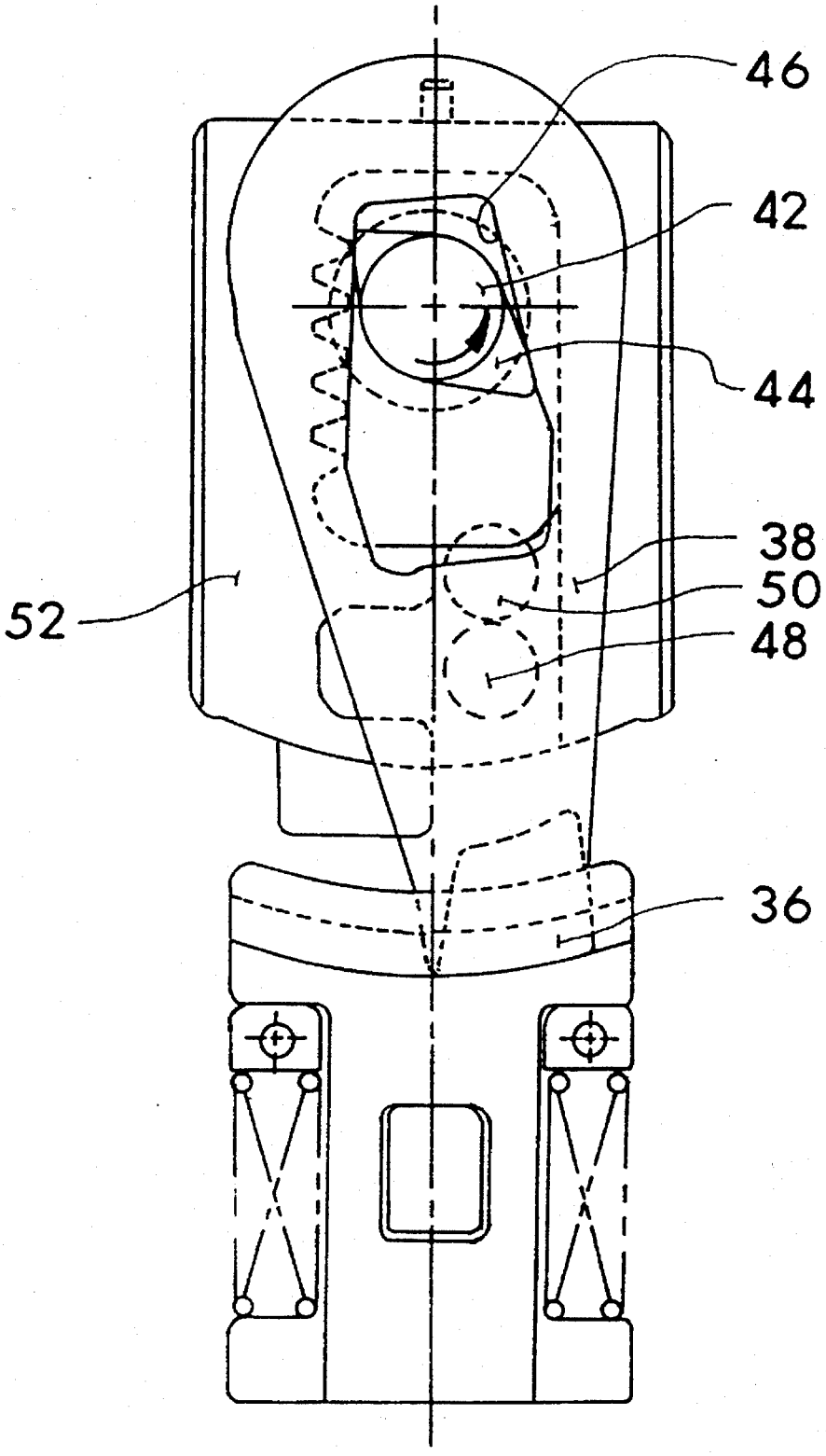
FIG. 2 is a front view illustrating the handleset with the locking arm at one position.

A cylinder lock having a cylinder assembly 40 is mounted on the front of the casing 22 and is connected to a spindle 42 which is integral with an actuator 44 which is located within the central opening 46 of the locking arm 38 (FIG. 2). Rotation of the round spindle by the key 47 in the cylinder assembly 40 will locate the locking arm at opposite ends of the connector flange groove.

Figure 3:
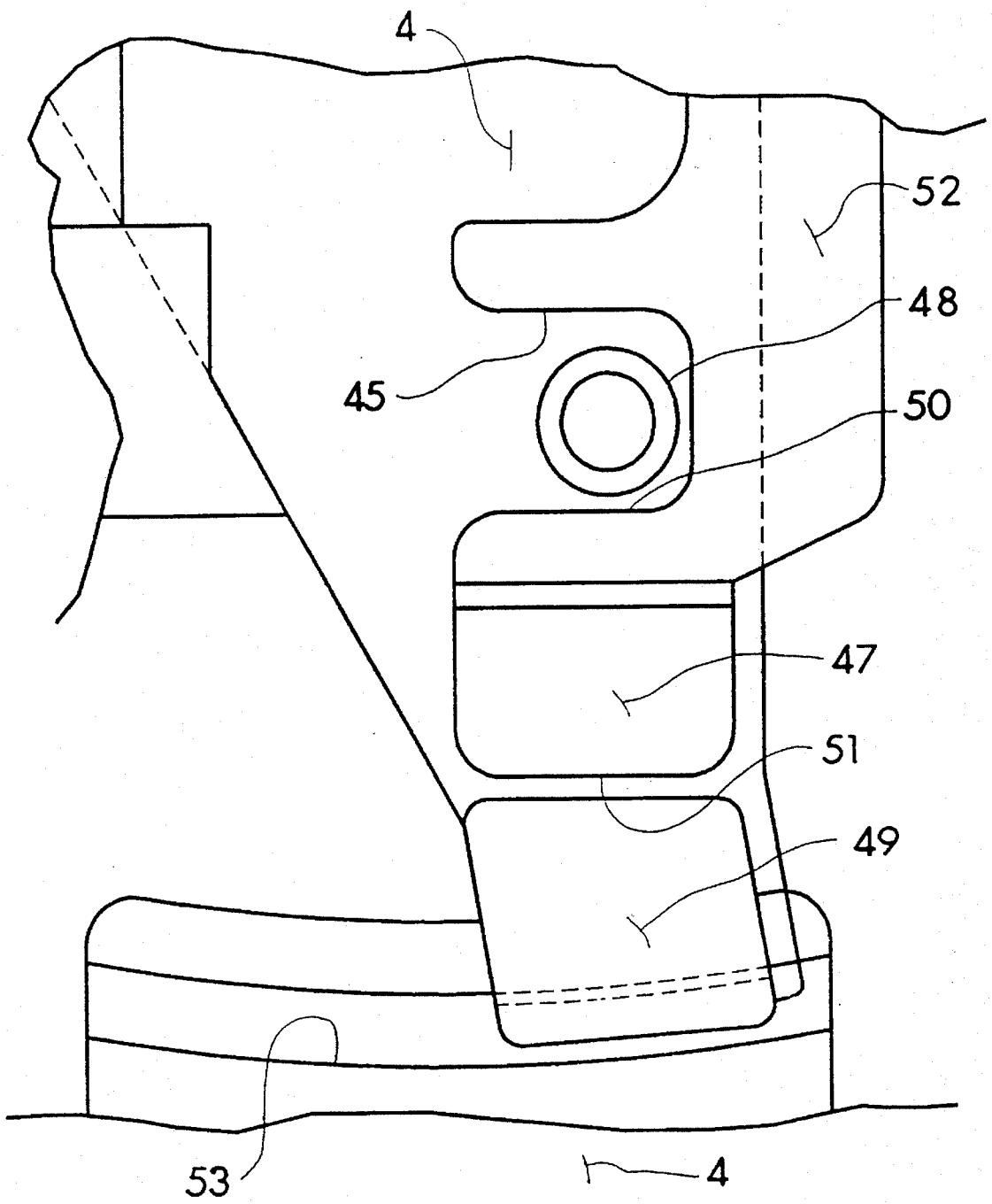
FIG. 3 is a rear view of a portion of the handleset shown in FIG. 2 with the locking arm at a second position.
Figure 4:
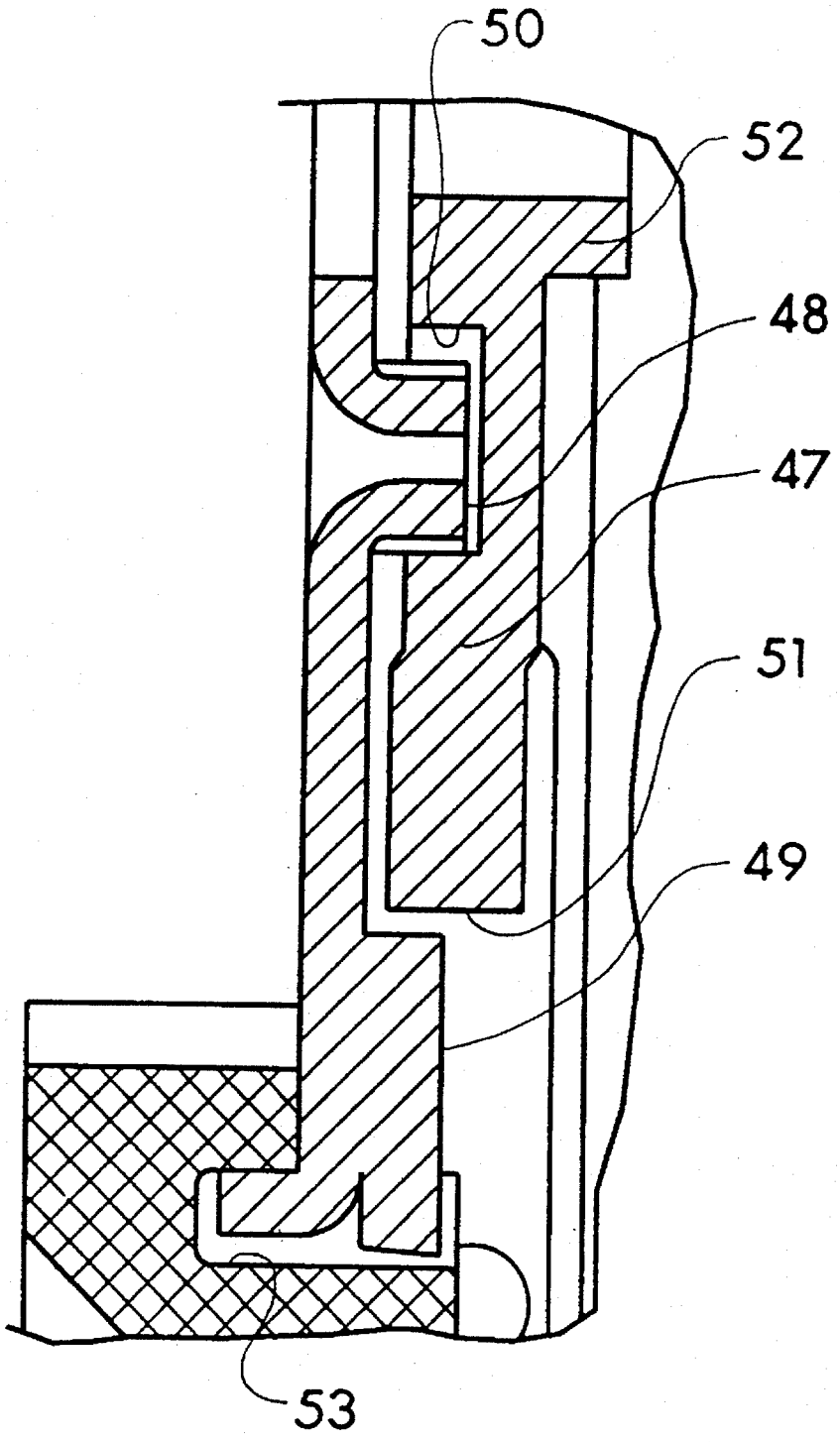
FIG. 4 is a view taken at 4—4 of FIG. 3.

The locking arm 38 has a projection 48 which is located within a T shaped (on its side) slot 50 (FIG. 3) which is defined in the rear surface of a rack 52. When the locking arm is pivoted to the right end of the connector groove, the pin 48 is located in the leg of the T shaped groove spaced from the top surface 45 of the groove and a bumper 47 at the bottom of the rack overlies a pad 49 at the bottom of the locking arm 38. The pad 49 is then located in a slot defined by the lower surface 51 of the bumper and the lower surface 53 of the arcuate slot 34. The spacing between the pad and the bumper is less than the spacing between the pin and the upper surface of the slot so that upward movement of the locking arm brings the pad into engagement with the bumper to drive the rack upwardly. When the thumb piece is released, the springs pull the locking arm down. The pin engages the slot and pulls the rack down. When the locking arm is shifted to the other end of the connector groove the pin will be located in the top portion of the T where vertical movement of the locking arm will not change the vertical position of the rack.

Rotatably mounted on the round spindle 42 is a pinion 56 for engaging with the teeth 57 on the rack. The pinion has a cap 58 and on top of the cap is located a hub 60 which has opposed ears 62 for entering cut outs 64 in a half round spindle 66. The half round spindle 66 is conventionally captured by a cylindrical spring biased sleeve (not shown) which enables the half round spindle to be pulled away from the hub and rotated 180° to change the lock from left handed to right handed operation. The assembly is held together by the cover 68 which is secured in place by screws 70. The half round spindle engages a latch assembly 80 and will rotate sufficiently to open the latch when the locking arm pin raises the rack when the thumbpiece is depressed.

Also intregral with the actuator 44 is a detent housing 82 which cooperates with spring 84 biased balls 86 retained within suitable casing slots 88.

I claim:

1. A handleset for operating a latch assembly comprising a half round spindle, a cylinder lock having a key operated cylinder assembly, a round spindle connected to said cylinder assembly for rotation with a key, a pinion mounted for rotation on said round spindle, said pinion and said half round spindle including interconnecting means so that rotation of said pinion will rotate said half round spindle, a rack having teeth engaged with said pinion, a connector displaceable between down and up positions, a pivotal thumb piece having a lever for displacing said connector from said down position to said up position, said connector having an arcuate slot, a locking arm having an arcuate flange for location in said arcuate slot, a projection, and a central opening, said round spindle including an actuator at a location selected so that said actuator will be located within said opening, said actuator and said opening being selectively configured so that turning the key from a neutral orientation to a lock open position will result in said actuator rotating said locking arm from a first position whereat said arcuate flange is at one end of said arcuate slot to a second position whereat said arcuate flange is at the other end of said arcuate slot, and said rack including a bumper at the bottom thereof and said locking arm having a pad selectively configured so that when said locking arm is at said neutral position said locking arm can move vertically relative to said rack so that pivoting the thumb piece will not rotate said half round spindle and so that when said locking arm is at said lock open position vertical upward movement of said locking arm will move said rack vertically so that pivoting the thumb piece will rotate said half round spindle.

2. A handleset according to claim 1, further comprising means for biasing said connector towards said down position.

3. A handleset according to claim 2, wherein said rack has an interior opening and said rack teeth are defined on a surface of said interior opening and said pinion is located within said interior opening.

4. A handleset according to claim 3, wherein said half round spindle has opposing notches at one end and said pinion includes a hub having outwardly projecting ears for insertion into said notches, said notches and said ears comprising said interconnecting means.

* * * * *